US006758206B1

(12) United States Patent
Barnes et al.

(10) Patent No.: US 6,758,206 B1
(45) Date of Patent: Jul. 6, 2004

(54) COOLING AND COMBUSTION AIRFLOW SUPPLY SYSTEM FOR A GAS RANGE

(75) Inventors: Shelton T. Barnes, Chattanooga, TN (US); Eddie Max Brock, Cleveland, TN (US); Christopher A. Larsen, Dorchester, MA (US); David C. Ometer, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,633

(22) Filed: Mar. 12, 2003

(51) Int. Cl.[7] ..... A21B 1/00

(52) U.S. Cl. ..... 126/21 R; 126/15 R; 126/19 R; 126/273 R; 126/41 R

(58) Field of Search ..... 126/21 R, 15 R, 126/15 A, 19 R, 21 A, 273 R, 39 R, 37 R, 41 R

(56) References Cited

U.S. PATENT DOCUMENTS 4,354,084 A * 10/1982 Husslein et al. ..... 219/757
4,375,213 A * 3/1983 Kemp et al. ..... 126/21 A
4,430,989 A * 2/1984 Narang et al. ..... 126/273 R
4,763,638 A * 8/1988 Hurley et al. ..... 126/21 A
4,796,600 A * 1/1989 Hurley et al. ..... 126/273 A
4,865,010 A * 9/1989 Kett ..... 126/21 R
5,193,520 A * 3/1993 Gostelow et al. ..... 126/21 A
5,738,081 A * 4/1998 Puricelli ..... 126/21 A

* cited by examiner

*Primary Examiner*—Jiping Lu
(74) *Attorney, Agent, or Firm*—Diederiks & Whitelaw, PLC

(57) ABSTRACT

A range includes a cabinet, defined by at least a front, side, bottom and top portions, as well as upper and lower oven cavities each having a respective gas burner assembly. At least one passageway is formed to create an airflow path enabling a portion of an ambient airflow introduced into the cabinet to reach the gas burner assemblies of the upper and lower oven cavities for combustion purposes, preferably through natural convection, while the remaining portion of the airflow passes over and cools portions of the range. In a preferred form of the invention, insulation is maintained in a desired position below a respective oven cavity by a holder through which the airflow passes to the burner assembly.

25 Claims, 3 Drawing Sheets

COOLING AND COMBUSTION AIRFLOW SUPPLY SYSTEM FOR A GAS RANGE

BACKGROUND OF THE INVENTION

1. Field of the Invention

The present invention pertains to the art of cooking appliances and, more particularly, to a system for supplying both a combustion airflow to a plurality of oven burners arranged within a range and a cooling airflow for cooling certain portions of the range.

2. Discussion of the Prior Art

In general, it is common to provide a system to supply combustion air to gas burners within a cooking appliance. It is also known to provide a system to cool a domestic oven or the like so that the exterior of the oven is safe to touch during operation of the oven, while further protecting any surrounding cabinetry from extreme heat.

Typically, a cooking appliance in the form of an oven range includes a single oven cavity and a pull-out drawer near the base of the range. In order for a gas burner to function efficiently, a sufficient amount of air must be available to fully combust the gas emitted from the burner. In most applications, the air flows around the drawer and into internal portions of the appliance. In addition, many prior art gas cooking appliances have often relied upon forced air systems for delivering sufficient air to the combustion and cooling systems. However, while effective, all such forced air systems have particular cost and reliability concerns. Specifically, the fan, its motor and associated controls add to the expense of the overall appliance and, often times, present long term reliability concerns. In order to ensure an adequate airflow, many prior art systems provide separate combustion and cooling airflow systems. Such systems necessarily increase the overall size of the unit making them unattractive for use in modern kitchen range systems.

Still other design problems arise in the particular arrangement of insulation within an appliance cabinet. In order to ensure a constant oven temperature, an insulation blanket is typically wrapped about the oven cavity. In addition to maintaining a heated atmosphere within the oven cavity, the insulation serves to lower internal, as well as external, appliance temperatures. In particular, insulation located between an oven cavity prevents the supporting surface, e.g., a kitchen floor, from being exposed to high temperatures generated with the oven.

In gas ranges, the insulation becomes a barrier to the airflow thus starving the burners of an adequate supply of air. As such, manufacturers typically remove the insulation from about the combustion components to ensure an adequate airflow to the burner(s). Other provisions include staggering the insulation in a plurality of layers. With this arrangement, heat is maintained within the oven cavity, while air is free to flow into the combustion areas. However, a drawback with this arrangement is the additional space required for multiple layers of insulation. Therefore, this option is not an attractive alternative for modem kitchen ranges, especially where space is of considerable concern.

Based on the above, there exists a need in the art of gas cooking appliances employing a natural convection flow for a system to supply a cooling and combustion airflow to a cooking appliance in the form of a dual oven range. In addition, there exists a need for a combustion and cooling system for a cooking appliance which includes an insulation layer below the lower oven cavity, while still enabling an adequate airflow to the combustion components.

SUMMARY OF THE INVENTION

In accordance with the present invention, a cooking appliance constituting a gas range includes a cabinet having first or upper and second or lower oven cavities, with the cabinet being generally defined by a front portion, opposing side panels and a base portion. The range further includes first and second burner assemblies positioned to radiate heat into the upper and lower oven cavities respectively. The oven cavities are spaced from the opposing side panels such that at least one passage is established between the oven cavities and an associated side panel.

In a preferred form of the present invention, an ambient air inlet opening is positioned in the front portion of the cabinet, adjacent to the base portion. With this arrangement, an ambient airflow is introduced into the cabinet through the inlet opening. In accordance with a more preferred form of the invention, a first portion of the airflow is directed to the first burner assembly, and a second portion is directed to the second burner assembly. As the airflow passes to the first oven cavity, a cooling effect is provided to the side panels of the cabinet. Once the first portion of the airflow reaches the first oven cavity, a portion of the airflow supplies combustion air to the first burner assembly, while another portion continues to cool interior surfaces of the range as the airflow passes from the range.

In the most preferred form of the present invention, a quantity of insulation extends laterally across a bottom of the second oven cavity and defines an elongated air channel which leads the second portion of the ambient airflow to the second burner assembly, while maintaining sufficient insulation below the oven cavity in a compact arrangement. With this construction, the second burner assembly is assured of an adequate air supply, while heat is maintained within the second oven cavity.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
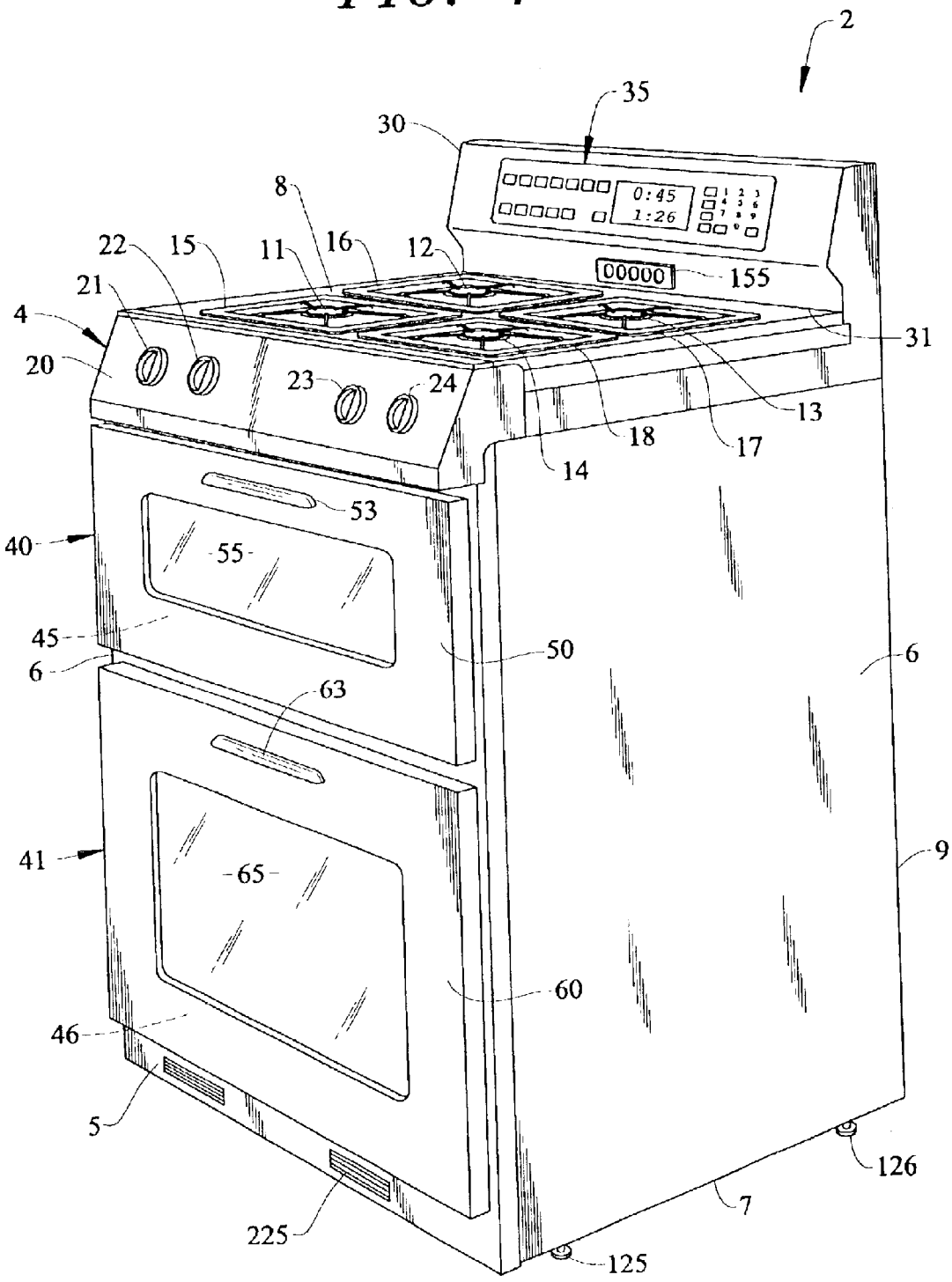
FIG. 1 is an upper right front perspective view of a cooking appliance incorporating a cooling and combustion airflow supply system configured in accordance with a preferred embodiment of the present invention.

With initial reference to FIG. 1, the cooling and combustion airflow supply system of the present invention is preferably incorporated into a cooking appliance generally indicated at 2. As shown, cooking appliance 2 takes the form of a free-standing gas range. Range 2 includes a cabinet 4 having a front panel portion 5, opposing side panel portions 6, bottom portion 7, a range top 8 and main back panel 9. In a manner known in the art, range top 8 can take on various forms. Specifically, in the embodiment shown, range top 8 is shown as a gas cooktop incorporating various gas burner elements 11–14, and associated burner grates 15–18. As shown, cabinet 4 further includes a front control surface 20. Preferably, control surface 20 supports a plurality of control knobs 21–24 for regulating the activation/de-activation of gas burners 11–14 respectively. Furthermore, cabinet 4 includes upstanding control panel 30 arranged at an upper rear portion 31 of cabinet 4. In the embodiment shown, control panel 30 includes a central control and display unit, generally indicated at 35, for use in controlling a first or upper oven 40 and a second or lower oven 41.

In a preferred embodiment, upper oven 40 includes a respective first or upper oven cavity 45 and, similarly, lower oven 41 includes a respective second or lower oven cavity 46. In a manner known in the art, upper oven 40 has associated therewith a door 50 which can be pivoted by means of a handle 53. Door 50 preferably includes a window 55 for viewing the contents of upper oven cavity 45. In a similar manner, lower oven 41 has associated therewith a door 60, a handle 63 and a window 65.

Upper and lower oven cavities 45 and 46 have respective bottom and sidewalls 66, 67 and 68, 69 respectively. Upper and lower oven cavities 45 and 46 also have arranged therein respective first or upper and second or lower burner assemblies 70 and 72. As shown, upper and lower burner assemblies 70 and 72 extend from rear walls 75 and 77 of upper and lower oven cavities 45 and 46 respectively. Furthermore, in order to maintain a heated atmosphere within upper and lower ovens 40 and 41, upper and lower insulation blankets 80 and 82 extend about upper exterior and side portions of upper and lower oven cavities 45 and 46. In addition, vertically arranged layers of insulation 85 and 86 are positioned against rear walls 75 and 77 of oven cavities 45 and 46.

Figure 2:
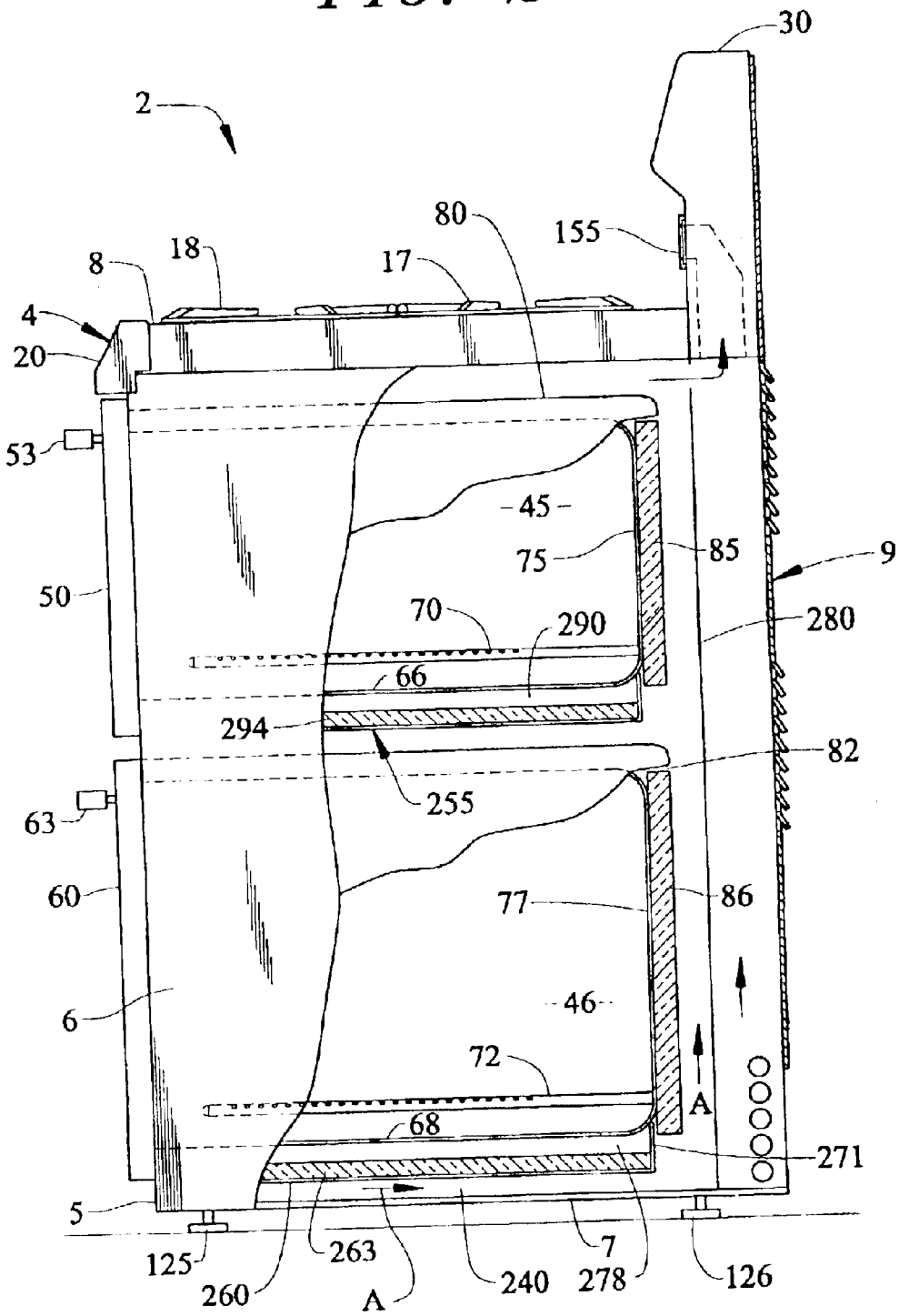
FIG. 2 is a partial, cross-sectional side view of the cooking appliance of FIG. 1.

In a manner known in the art, range 2 is adapted to be mounted upon a supporting surface, such as a kitchen floor or the like. More specifically, a plurality of leg members, two of which are indicated in FIGS. 1 and 2 at 125 and 126, extend from bottom portion 7 at front and rear portions of cabinet 4 along side panel portion 6. Of course, corresponding leg members are also provided on the opposing side of range 2. In any event, the various leg members 125 and 126 are preferably vertically adjustable to also act as levelers for range 2. Such type of leg leveler arrangements are widely known in the art of appliances, including both ranges and refrigerators such that the leveling function of leg members 125 and 126 does not form part of the present invention.

When using gas burner assemblies 70 and 72 for heating purposes, an adequate supply of combustion air must be present to efficiently operate range 2. In addition, a cooling air supply is desired to maintain external temperatures at acceptable levels. The present invention is particularly directed to a system for supplying a cooling and combustion airflow to range 2, with both airflows being preferably vented through an exhaust outlet 155. Specifically, the system will supply cooling air to internal portions of range 2, while ensuring an adequate supply of combustion air to upper and lower oven cavities 45 and 46 as will be detailed fully below.

Figure 3:
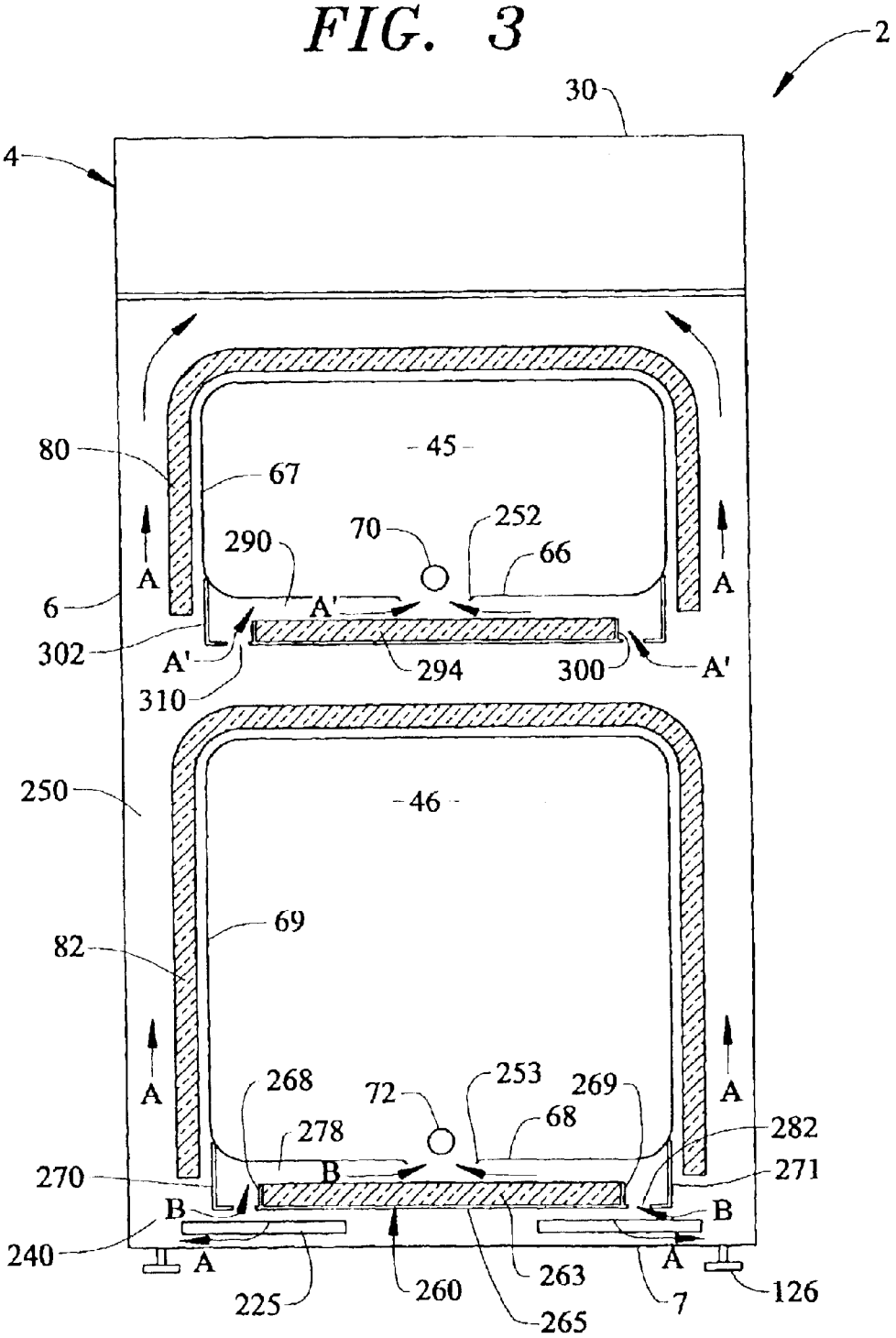
FIG. 3 is a rear, cross-sectional view of the cooking appliance of FIG. 1, showing the particular oven cavity and insulation arrangement.

Referring to FIGS. 1–3, the cooling and combustion airflow system of the present invention includes at least one vent opening 225 which establishes a passage for an ambient airflow to enter cabinet 4. Preferably vent opening 225 is arranged on front portion 5 adjacent to base portion 7. As shown, each vent opening 225 takes the form of louvers which are stamped out of front portion 5 and lead to a first passageway 240 arranged above base portion 7. As will be set forth more fully below, first passageway 240 opens into cabinet 4 enabling both cooling and combustion airflows to enter interior portions of appliance 2.

Upper and lower oven cavities 45 and 46 have associated sidewall portions (not separately labeled) arranged in a spaced relationship from side panels 6 such that a second passageway 250 is formed as indicated in FIG. 3. In a preferred form of the invention, second passageway 250 is fluidly connected to first passageway 240 such that the ambient airflow can pass up to oven cavities 45 and 46, which have lower openings 252 and 253 leading to gas burner assemblies 70 and 72 respectively. With this arrangement, ambient air entering inlet vent(s) 225 enters first passageway 240, preferably through a process of natural convection. At this point, the ambient airflow diverges into first and second airstreams A and B.

Airstream A passes into second passageway 250 and travels up side panel 6 to upper oven cavity 45. As airstream A travels upward, side panel portion 6 is cooled through a convection heat transfer process. Once airstream A reaches upper oven cavity 45, a portion A' of airstream A supplies combustion air to burner assembly 70 through a first insulation holder 255. Similarly, an airstream B passes from first passageway 240 and travels upward to supply combustion air to burner assembly 72. More specifically, with further reference to the supply of combustion air to burner assembly 72, a second insulation holder 260, which is preferably constituted by a thin metal box, supports an insulation pad 263 below lower oven cavity 46. Second insulation holder 260 preferably includes a base 265, a pair of upstanding inner side walls 268 and 269, and a pair of upstanding outer side walls 270 and 271.

As clearly shown in FIG. 3, upstanding inner side walls 268 and 269 confine insulation pad 263 upon a central portion of base 265. At the same time, upstanding outer side walls 270 and 271 extend from bottom wall 68 of oven cavity 46 and maintain insulation pad 263 spaced a predetermined distance from bottom wall 68 such that an elongated air channel 278 defined between insulation pad 263 and bottom portion 68 of second oven cavity 46. In accordance with the most preferred embodiment of the invention, insulation pad 263 extends continuously and uninterrupted beneath second oven cavity 46. However, on either side of and laterally outwardly of insulation pad 263, base 265 is formed with one or more inlet ports 282. With this arrangement, airstream B can freely flow to lower burner assembly 72 from first passageway 240, through inlet ports 282, across air channel 278, and in through lower opening 253. At the same time, insulation pad 263 is maintained in a desired heat retention position away from inlet ports 282 and relatively close to oven cavity 46, thereby addressing space requirements and establishing an extremely compact arrangement. At the same time, the combined arrangement of insulation blanket 80 and insulation pad 263 essentially wrap oven cavity 46, with a minimum of space, to assure effective heat retention.

At this point, it should be realized that a similar air channel 290 is defined between an insulation pad 294 held by first insulation holder 255 and bottom portion 66 of first oven cavity 45 for the flow of combustion airstream A' through opening 252. That is, first insulation holder 255 includes corresponding inner and outer upstanding walls 300 and 302, as well as inlet ports 310, for establishing the desired flow path for airstream A' to burner assembly 70.

In the manner described above, each burner assembly 70 and 72 is assured of an adequate supply of combustion air, preferably through natural convection, to efficiently maintain a heated atmosphere within respective oven cavities 45 and 46. The remaining airflow continues upward through cabinet 4, within the confines of an internal partition plate 280, cooling internal portions of range 2 until passing through to an exhaust outlet 155. At this point, it should be noted that the particular method and structure relating to the exhaust system does not form part of the present invention, and is actually set forth in co-assigned U.S. Patent Application entitled "EXHAUST COOLING SYSTEM FOR A COOKING APPLIANCE" filed on even date herewith and hereby incorporated by reference.

Although described with reference to a preferred embodiment of the invention, it should be readily understood that various changes and/or modifications can be made to the invention without departing from the spirit thereof. For instance, the particular construction and arrangement of the openings which fluidly interconnect the burner assemblies with the ambient airflow could be readily altered without departing from the spirit of the invention. Although the invention has been discussed with reference to a single passageway running between one side panel and the oven cavities, a similar passage also exists along the opposing side panel, thereby increasing the amount of cooling and combustion air to the range. In any case, provisions could be made for additional flow passages, such as below the top surface and/or rear panels. Furthermore, it should be realized that terms such as "first" and "second" have only been utilized for the sake of convenience in describing the invention and should not be considered to limit the scope of the invention. Instead, the invention is only intended to be limited by the scope of the following claims.

We claim:

1. A cooking appliance comprising:

a cabinet including at least a front portion, opposing side panels, a base portion, a back panel and a top surface, said cabinet being adapted to rest upon a supporting surface;

a plurality of gas burners arranged about the top surface;

first and second oven cavities arranged within the cabinet, each of said first and second oven cavities including respective sidewall portions maintained in a spaced relationship from the opposing side panels such that at least one passageway is defined between the cabinet side panels and the sidewall portions of the first and second oven cavities;

a first burner assembly positioned to heat the first oven cavity;

a second burner assembly positioned to heat the second oven cavity; and at least one airflow inlet opening arranged along the front panel adjacent to the base portion, said at least one airflow inlet being adapted to direct an ambient airflow into the passageway, whereupon a first portion of the airflow is adapted to flow to the first oven cavity to supply combustion air to the first burner assembly, a second portion of the airflow is adapted to flow to the second oven cavity to supply combustion air to the second burner assembly, and a third portion of the airflow functions as a cooling airflow within the cabinet.

2. The cooking appliance according to claim 1, further comprising:

an insulation holder mounted below the second oven cavity; and a quantity of insulation supported upon the insulation holder.

3. The cooking appliance according to claim 2, wherein the quantity of insulation material defines, at least in part, a passage through which the second portion of the airflow is directed to the second oven cavity.

4. The cooking appliance according to claim 3, further comprising: at least one inlet port formed in the insulation holder for introducing the second portion of the airflow from the passageway to the passage.

5. The cooking appliance according to claim 4, wherein the insulation holder includes a base, said at least one inlet port being formed in the base in fluid communication with the passage.

6. The cooking appliance according to claim 4, wherein the insulation holder includes upstanding outer walls which space the insulation holder from the second oven cavity.

7. The cooking appliance according to claim 6, wherein the insulation holder further includes upstanding inner walls for retaining the quantity of insulation in a desired position.

8. The cooking appliance according to claim 2, further comprising:

an insulation blanket extending about a portion of the second oven cavity, said second oven cavity being substantially, completely wrapped by the insulation blanket and the quantity of insulation.

9. The cooking appliance according to claim 1, further comprising:

a first insulation blanket extending about multiple wall portions of the first oven cavity;

a first insulation layer positioned against another wall portion of the first oven cavity;

a second insulation blanket extending about multiple wall portions of the second oven cavity; and a second insulation layer positioned against another wall portion of the second oven cavity.

10. The cooking appliance according to claim 8, further comprising: a third insulation layer positioned along a still further wall portion of the second oven cavity, said second oven cavity being substantially encapsulated by the second insulation blanket, the second insulation layer and the third insulation layer.

11. A cooking appliance comprising:

a cabinet including at least a front portion, opposing side panels, a base portion, a back panel and a top surface, said cabinet being adapted to rest upon a supporting surface;

a plurality of gas burners arranged about the top surface;

first and second oven cavities arranged within the cabinet, each of said first and second oven cavities including respective bottom and sidewall portions maintained in a spaced relationship from the opposing side panels such that at least one passageway is defined between the cabinet side panels and the sidewall portions of the first and second oven cavities;

a first burner assembly positioned to heat the first oven cavity;

a second burner assembly positioned to heat the second oven cavity; and a quantity of insulation material extending along the bottom portion of the second oven cavity, said insulation material defining, at least in part, a passage arranged between the bottom portion of the second oven cavity and the insulation material, said passage directing a combustion airflow for introduction to the second oven cavity.

12. The cooking appliance according to claim 11, further comprising:

an insulation holder arranged beneath the second oven cavity, said quantity of insulation material being supported by the insulation holder.

13. The cooking appliance according to claim 12, further comprising:

at least one inlet port formed in the insulation holder for introducing the combustion airflow from the passageway to the passage.

14. The cooking appliance according to claim 13, wherein the insulation holder includes a base, said at least one inlet port being formed in the base in fluid communication with the passage.

15. The cooking appliance according to claim 13, wherein the insulation holder includes upstanding outer walls which space the insulation holder from the second oven cavity.

16. The cooking appliance according to claim 15, wherein the insulation holder further includes upstanding inner walls for retaining the quantity of insulation material in a desired position.

17. The cooking appliance according to claim 11, further comprising:

a first insulation blanket extending about multiple wall portions of the first oven cavity;

a first insulation layer positioned against another wall portion of the first oven cavity;

a second insulation blanket extending about multiple wall portions of the second oven cavity; and a second insulation layer positioned against another wall portion of the second oven cavity.

18. The cooking appliance according to claim 17, wherein said second oven cavity is substantially encapsulated by the second insulation blanket, the second insulation layer and the quantity of insulation material extending along the bottom of the second oven cavity.

19. A method of supplying both combustion and cooling air to a cooking appliance including a cabinet having at least a front portion, a base portion, first and second oven cavities arranged within the cabinet, first and second burner assemblies for heating the first and second oven cavities respectively, and a plurality of surface burner units, said method comprising:

directing an ambient airflow into the cabinet;

guiding a first portion of the ambient airflow to the first oven cavity as combustion air when the first burner assembly is activated;

guiding a second portion of the ambient airflow to the second oven cavity as combustion air when the second burner assembly is activated;

directing remaining portions of the ambient airflow about the first and second oven cavities within the cabinet; and exhausting at least a percentage of the ambient airflow.

20. The method of claim 19, further comprising: drawing the first and second portions of the ambient airflow into the first and second oven cavities through natural convection.

21. The method of claim 19, further comprising: delivering the first portion of the ambient airflow to the first oven cavity through an insulation holder positioned directly below and extending across the first oven cavity.

22. The method of claim 21, further comprising: guiding the first portion of the ambient airflow to the first oven cavity through inlet ports formed in the insulation holder.

23. The method of claim 22, further comprising: directing the airflow to the first oven cavity through an elongated, laterally extending air passage arranged between a bottom portion of the first oven cavity and a quantity of insulation material arranged below the first oven cavity on the insulation holder.

24. The method of claim 23, further comprising: maintaining a desired spacing between the quantity of insulation material and the bottom portion of the first oven cavity through the insulation holder.

25. The method of claim 23, further comprising: retaining the quantity of insulation between upstanding walls of the insulation holder in order to maintain the quantity of insulation spaced from the inlet ports.

* * * * *